US009115719B2

(12) United States Patent
Sadakata et al.

(10) Patent No.: US 9,115,719 B2
(45) Date of Patent: Aug. 25, 2015

(54) SCROLL FLUID MACHINE WITH COOLING FAN AND PASSAGE

(71) Applicant: Hitachi Industrial Equipment Systems Co., Ltd., Chiyoda-ku, Tokyo (JP)

(72) Inventors: Kosuke Sadakata, Tokyo (JP); Kiminori Iwano, Sagamihara (JP); Yoshio Kobayashi, Ebina (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 52 days.

(21) Appl. No.: 13/953,335

(22) Filed: Jul. 29, 2013

(65) Prior Publication Data

US 2014/0154122 A1 Jun. 5, 2014

(30) Foreign Application Priority Data

Nov. 30, 2012 (JP) ..... 2012-261858

(51) Int. Cl.
*F04C 29/04* (2006.01)
*F04C 15/00* (2006.01)
(Continued)

(52) U.S. Cl.
CPC ..... *F04C 29/04* (2013.01); *F04C 15/0096* (2013.01); *F04C 18/0215* (2013.01); *F01C 21/10* (2013.01)

(58) Field of Classification Search
CPC ..... F04C 18/0215; F04C 19/004; F04C 15/0096; F04C 29/04; F01C 21/10; F01C 21/06
USPC ..... 418/55.1–55.6, 101, 83, 57
See application file for complete search history.

(56) References Cited

U.S. PATENT DOCUMENTS 4,129,405 A * 12/1978 McCullough ..... 418/55.2
5,417,554 A * 5/1995 Kietzman et al. ..... 418/55.2
6,190,145 B1 * 2/2001 Fujioka et al. ..... 418/55.1
(Continued)

FOREIGN PATENT DOCUMENTS

EP 2224136 A2 * 9/2010
JP 2000-120568 A 4/2000
(Continued)

OTHER PUBLICATIONS

"Engineers hand-book of tables, charts and data on the application of centrifugal fans and fan system . . . ", 1914, The Buffalo Forge Company, p. 120-126.*
(Continued)

*Primary Examiner* — Thomas Denion
*Assistant Examiner* — Xiaoting Hu
(74) *Attorney, Agent, or Firm* — Crowell & Moring LLP

(57) ABSTRACT

A scroll fluid machine having: a compressor body including a fixed scroll and an orbiting scroll opposed to the fixed scroll, the orbiting scroll orbiting; a drive shaft connected to the orbiting scroll; a cooling fan provided on another side of the drive shaft opposite to the orbiting scroll, the cooling fan generating a cooling wind; and a cooling wind passage surrounded by walls in all directions, the cooling wind passage sending the cooling wind of the cooling fan to the compressor body, when the cooling wind passage being disposed left and the drive shaft being disposed right when seen from a direction in which the drive shaft extends, a size of the cooling wind passage in the left and right directions being smaller in upstream than downstream of the cooling wind passage.

12 Claims, 3 Drawing Sheets

(51) Int. Cl.
*F04C 18/02* (2006.01)
*F01C 21/10* (2006.01)

(56) References Cited

U.S. PATENT DOCUMENTS

| | | | | |
|---|---|---|---|---|
| 2005/0169788 | A1* | 8/2005 | Komai et al. | 418/55.6 |
| 2009/0087331 | A1* | 4/2009 | Komai et al. | 418/55.1 |
| 2010/0028185 | A1* | 2/2010 | Kobayashi et al. | 418/55.4 |
| 2011/0300012 | A1* | 12/2011 | Fujioka et al. | 418/55.1 |
| 2012/0189480 | A1* | 7/2012 | Yamazaki et al. | 418/55.2 |

FOREIGN PATENT DOCUMENTS

| | | | | |
|---|---|---|---|---|
| JP | 2000291574 | A | * | 10/2000 |
| JP | 2001-336488 | A | | 12/2001 |
| JP | 2001336488 | A | * | 12/2001 |
| JP | 2005-139976 | A | | 6/2005 |
| JP | 2010007644 | A | * | 1/2010 |

OTHER PUBLICATIONS

Korean Office Action dated Oct. 8, 2014 (Three (3) pages).

* cited by examiner

SCROLL FLUID MACHINE WITH COOLING FAN AND PASSAGE

INCORPORATION BY REFERENCE

The present application claims priority from Japanese patent application JP2012-261858 filed on Nov. 30, 2012, the content of which is hereby incorporated by reference into this application.

BACKGROUND OF THE INVENTION

The present invention relates to a scroll fluid machine.

JP-A-2000-120568 discloses a scroll fluid machine in which a cooling gas from a cooling fan is flowed in an introduction passage (a cooling wind passage) to cool a scroll body.

JP-A-2001-336488 discloses a scroll fluid machine that includes an upper side duct externally cooling an electric motor with a cooling wind from a cooling fan and a scroll duct connected to the upper side duct and cooling a fixed scroll.

SUMMARY OF THE INVENTION

In the scroll fluid machine disclosed in JP-A-2000-120568, when the introduction passage (cooling wind passage) is disposed left and the scroll body is disposed right, the dimension of the introduction passage in the left and right directions is constant. Therefore, when the cooling wind from the cooling fan is flowed in the introduction passage, the centrifugal force biases the cooling wind externally toward the fixed scroll, thereby reducing the cooling wind flow on the orbiting scroll side. Therefore, the orbiting scroll, which includes a driving portion and thus the cooling is important, has insufficient cooling efficiency.

In the scroll fluid machine disclosed in JP-A-2001-336488, the cooling wind after cooling the electric motor in the upper side duct is supplied to the fixed scroll, thereby providing insufficient cooling efficiency of the fixed scroll.

In view thereof, it is an object of the present invention to provide a scroll fluid machine that includes a cooling wind passage for flowing a cooling wind from a cooling fan in a compressor body and has a different dimension between the upstream side and the downstream side, thereby improving the cooling efficiency of the compressor body.

To solved the above issues, the present invention provides a scroll fluid machine including: a compressor body including a fixed scroll and an orbiting scroll opposed to the fixed scroll, the orbiting scroll orbiting; a drive shaft connected to the orbiting scroll; a cooling fan provided on the other side of the drive shaft opposite to the orbiting scroll, the cooling fan generating a cooling wind; and a cooling wind passage surrounded by walls in all directions, the cooling wind passage sending the cooling wind of the cooling fan to the compressor body, when the cooling wind passage being disposed left and the drive shaft being disposed right when seen from a direction in which the drive shaft extends, a dimension of the cooling wind passage in the left and right directions being smaller upstream than downstream of the cooling wind passage.

The present invention may provide a scroll fluid machine that has improved cooling efficiency of a compressor body.

Other objects, features and advantages of the invention will become apparent from the following description of the embodiments of the invention taken in conjunction with the accompanying drawings.

DESCRIPTION OF THE EMBODIMENTS

With reference to the accompanying drawings, the present invention will be described in more detail using an example of a scroll air compressor as a scroll fluid machine according to the embodiments of the present invention.

Embodiment 1

Figure 1:
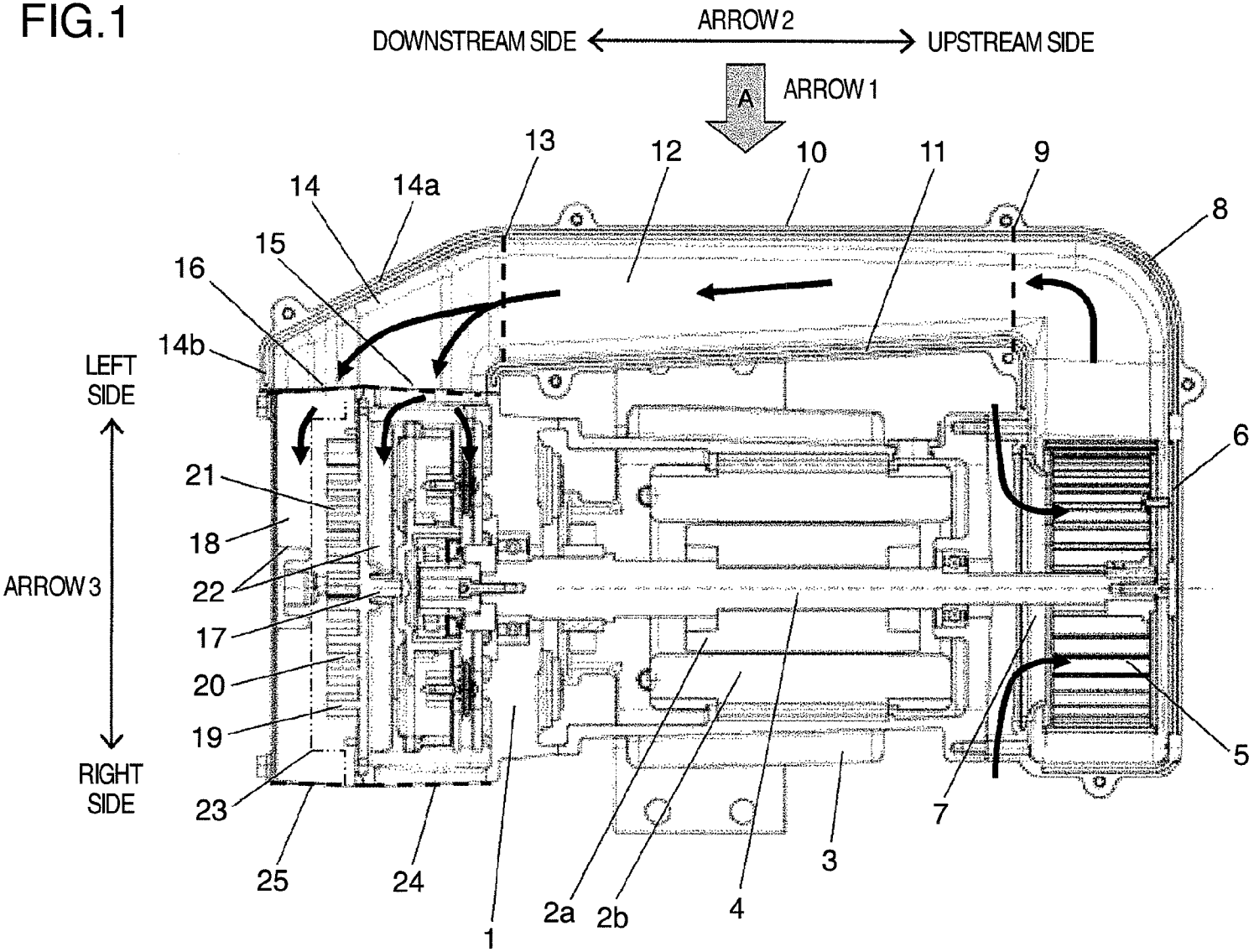
FIG. 1 is a cross-sectional view of an entire structure of a scroll compressor according to Embodiment 1 of the present invention.

With reference to FIG. 1, an entire structure of a scroll compressor according to Embodiment 1 of the present invention will be described.

A compressor body 1 includes an orbiting scroll 17 and a fixed scroll 18 opposite to each other. The opposite faces of the orbiting scroll 17 and the fixed scroll 18 have spiral wrap portions 19 and 20 vertically arranged thereon respectively. The wrap portions 19 and 20 form compression chambers 21. In addition, a drive shaft 4 has an eccentric portion (not shown) provided on the compressor body 1 side thereof. The drive shaft 4 is connected to the orbiting scroll 17 to rotationally drive the orbiting scroll 17. The orbiting scroll 17 includes a rotation-preventing mechanism (not shown). The drive shaft 4 provides an orbiting (eccentric) motion of the orbiting scroll 17 with respect to the fixed scroll 18, thereby compressing the air.

A motor drives the compressor body 1. The motor includes a motor casing 3, which accommodates a rotor 2*a* and a stator 2*b*. The drive shaft 4 passes through the rotor 2*a* and is attached thereto. The motor is coupled to the drive shaft 4. In addition, a cooling fan 5 for generating a cooling wind is attached on the side of the drive shaft 4 opposite to the orbiting scroll 17.

The cooling fan 5 is accommodated in a fan casing 6 attached to the motor casing 3. The motor 2 is driven to rotate the cooling fan 5, thereby sucking a cooling gas from the cooling wind inlet 7 to generate the cooling wind. After being generated by the cooling fan 5, the cooling wind is redirected by a bend 8 of the fan casing 6. The cooling wind is then flowed in a cooling wind passage (a fan duct) 12. The cooling wind passage 12 is surrounded by four walls (an outside wall 10, an inside wall 11, an upper side wall 27, and a lower side wall 28) provided to a connection 9. The cooling wind passage 12 is separated from the heat-producing motor 2 (the motor casing 3) by the inside wall 11. The cooling wind passage 12 may thus supply a low-temperature cooling wind to the compressor body 1 without being affected by the heat generation of the motor 2. After flowing in the cooling wind passage 12, the cooling wind flows from upstream to downstream of the arrow 2 in FIG. 1. The cooling wind then flows in an introduction guide 14 that is connected to the cooling wind passage 12 downstream of the arrow 2 in FIG. 1. After flowing in the introduction guide 14, the cooling wind is redirected by wind introduction walls 14*a* and 14*b* and flows in cooling wind inlets 15 and 16 of the compressor body 1. Thus, the cooling wind flows toward cooling fins 22 on the backsides of the orbiting scroll 17 and the fixed scroll 18, thereby cooling the compressor body 1. After cooling the compressor body 1, the cooling wind is discharged from cooling wind outlets 24 and 25.

Figure 2:
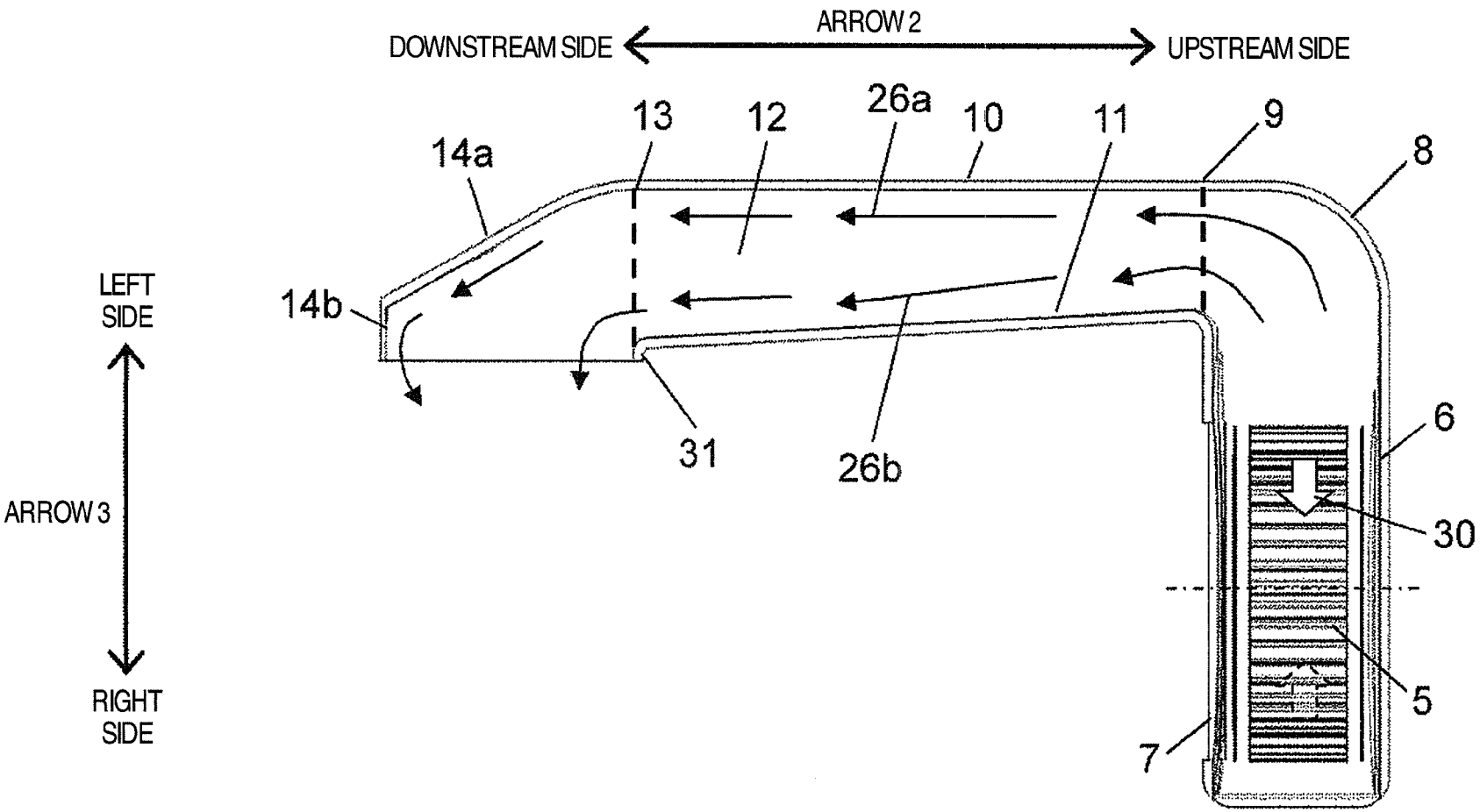
FIG. 2 is another cross-sectional view of the cooling wind passage of the scroll compressor according to Embodiment 1 of the present invention.

With reference now to FIG. 2, the flow of the cooling wind in this embodiment will be described in more detail. FIG. 2 shows the cooling wind passage 12 as viewed from the top when the cooling wind passage 12 is disposed left and the drive shaft 4 is disposed right when seen from the direction (longitudinal direction) in which the drive shaft 4 extends. Note that the side of the cooling wind passage 12 near the drive shaft 4 is defined as inside, and the side far from the drive shaft 4 is defined as outside. In addition, the side of the cooling wind passage 12 to which the cooling wind is supplied from the cooling fan 5 is defined as upstream, and the side from which the cooling wind is discharged toward the compressor body 1 is defined as downstream.

The rotation of the cooling fan 5 sucks a cooling gas from the cooling wind inlet 7 and then pushes out the cooling gas toward the rotational direction (the hollow arrow direction 30 in FIG. 2) of the cooling fan 5. After leaving the cooling fan 5, the cooling wind is redirected by the bend 8 toward the cooling wind passage 12. The cooling wind then flows in the cooling wind passage 12 and flows downstream of the arrow 2.

Then, when the cooling wind flows through the bend 8, the centrifugal force produces the mainstream on the outside of the cooling wind (the left side of the arrow 3). Thus, after having passed through the connection 9, the flow of the cooling wind tends to lean toward the outside wall 10.

Therefore, the cooling wind passage 12 in this embodiment is formed such that the dimension in the left and right directions (the arrow 3 directions in FIG. 2) increases from upstream to downstream. Specifically, the inside wall 11 is brought closer to the outside wall 10 at the casing connection 9, thereby inclining the inside wall 11 to expand the cooling wind passage 12 toward the connection 13. Thus, the distance between the inside wall 11 and the outside wall 10 at the inlet of the cooling wind passage (the connection 9) is smaller than the distance between the inside wall 11 and the outside wall 10 at the outlet of the cooling wind passage (the connection 13). Note that the outside wall 10 is in parallel with the drive shaft 4.

Bringing the inside wall 11 closer to the outside wall 10 at the connection 9 upstream of the cooling wind passage 12 may reduce the flow velocity difference between the flow near the outside wall 26*a* and the flow near the inside wall 26*b*. This may reduce the vortex generated by the flow velocity difference and thus reduce the loss. In addition, the inside wall 11 is inclined toward the drive shaft 4 downstream of the cooling wind passage 12 to bring the inside at the outlet of the cooling wind passage 12 (the connection 13) closer to the drive shaft 4 than the inside at the inlet (the connection 9). A flow toward the right of the arrow 3 is thus generated, thereby preventing the cooling wind from being biased to the fixed scroll 18, and thus reducing the reduction of the cooling efficiency of the orbiting scroll 17.

Further, the inside wall 11 is inclined toward the drive shaft 4 downstream of the cooling wind passage 12, and thus the inside wall 11 may be smoothly connected to the cooling wind inlet 15 on the orbiting scroll 17 side of the compressor body 1. This may decrease the curvature of the bend section 31 that connects the flow passage connection 13 to the cooling wind inlet 15 on the orbiting scroll side, thereby reducing the effect of the centrifugal force, reducing the vortex generation at the bend section 31 connected to the introduction duct 14, and reducing the flow passage loss.

Here, JP-A-2000-120568 discloses a configuration in which, unlike this embodiment, the outside wall and the inside wall are disposed in parallel with the drive shaft and thus a flow is generated that is biased to the outside of the cooling wind passage by the centrifugal force. Further, the protrusion generates the vortex, which increases the loss.

In this embodiment, after reaching the passage connection 13, the cooling wind is supplied to the compressor body 1 via the introduction duct 14. The introduction wall 14*a* of the introduction duct 14 is formed as a straight line inclined toward the cooling wind inlet 16 on the fixed scroll side. This may smoothly connect the cooling wind passage 12 and the cooling wind inlet 16 on the fixed scroll side, thereby reducing the flow passage loss due to the vortex generation. In addition, the connection 13 makes the flow velocity uniform, and thus the cooling wind may be flowed to the orbiting scroll 17 and the fixed scroll 18 in a proper balance. In addition, the introduction wall 14*b* may cause the cooling wind to collide with the introduction wall 14*b*, thereby generating a flow toward the cooling fin bottom 23 of the fixed scroll 18 to be cooled. The orbiting scroll 17 and the fixed scroll 18 may thus be cooled efficiently. Note that the introduction wall 14*b* may be inclined toward the cooling fin bottom 23 to provide the same effect.

Thus, according to this embodiment, the dimension in the left and right directions upstream of the cooling wind passage 12 is formed smaller than the dimension in the left and right directions on the downstream side. This may reduce the flow passage difference between the outside and the inside of the cooling wind passage 12, thereby reducing the flow passage loss due to the vortex generation and thus improving the cooling efficiency of the compressor body 1. In addition, the inside wall 11 is inclined toward the drive shaft 4 downstream of the cooling wind passage 12. This may reduce the flow passage loss due to the vortex generation in the introduction duct 14, thereby improving the cooling efficiency of the compressor body 1. In addition, the introduction wall 14*a* of the introduction duct 14 is inclined toward the cooling wind inlet 16 on the fixed scroll side. This may reduce the flow passage loss duo to the vortex generation in the introduction duct 14, thereby improving the cooling efficiency of the compressor body 1.

Embodiment 2

Figure 3:
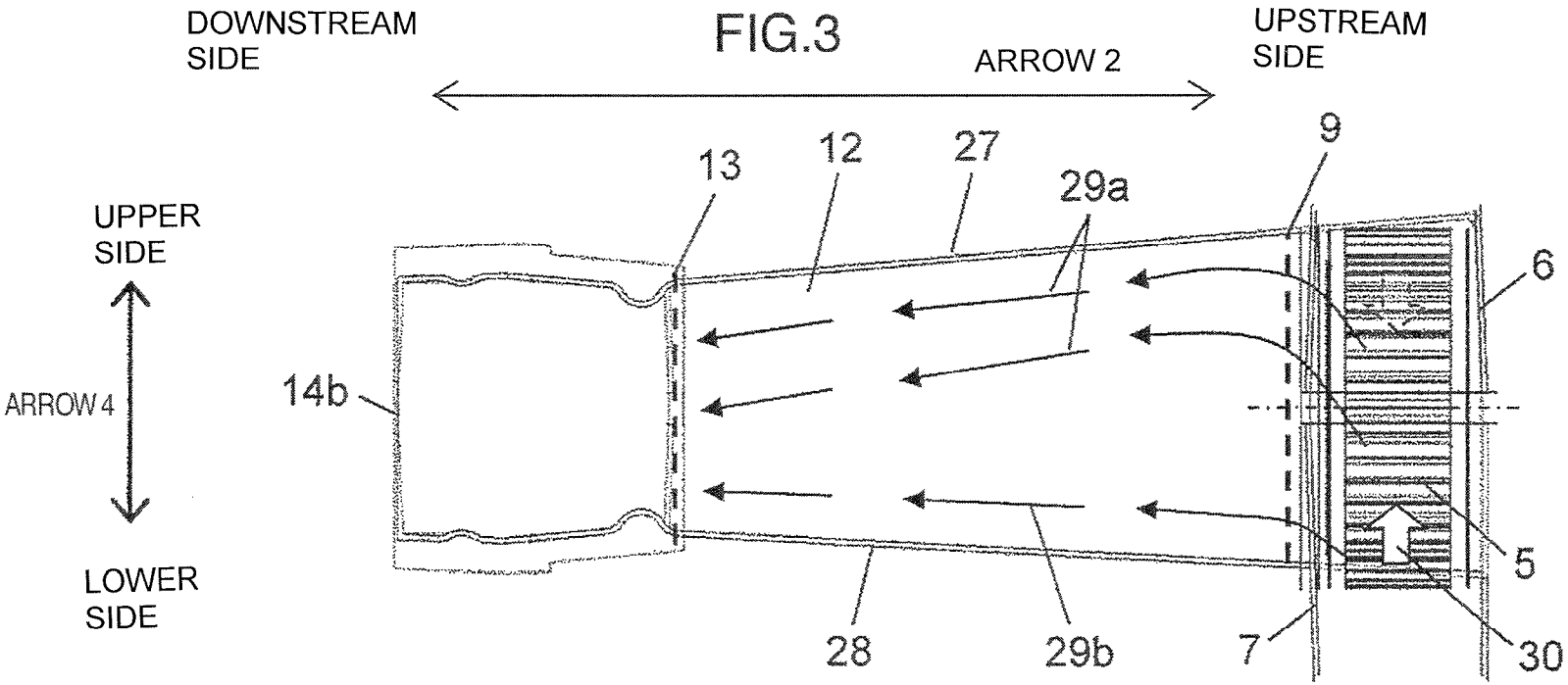
FIG. 3 is a cross-sectional view of a cooling wind passage of a scroll compressor according to Embodiment 2 of the present invention.

With reference to FIG. 3, Embodiment 2 of the present invention will be described. Like elements as those in Embodiment 1 are designated with like reference numerals and their detailed description is omitted here. FIG. 3 shows the cooling fan 5 and the cooling wind passage as viewed from the left side (the left side of the arrow 3 in FIG. 2) when the cooling wind passage 12 is disposed left and the drive shaft 4 is disposed right when seen from the direction (longitudinal direction) in which the drive shaft 4 extends. This embodiment has a feature that the dimension in the upper and lower directions upstream of the cooling wind passage 12 is larger than the dimension in the upper and lower directions on the downstream side.

Therefore, in this embodiment, the dimension in the upper and lower directions (of the arrow 4 in FIG. 3) upstream of the cooling wind passage 12 is formed larger than the dimension in the upper and lower directions on the downstream side, and thus the distance between the upper side wall 27 and the lower side wall 28 is reduced toward the downstream of the arrow 2. This may increase the cross sectional area of the casing-side flow passage connection 9 upstream of the cooling wind passage 12, thereby reducing the flow passage loss in the casing-side flow passage connection 9, and thus ensuring the amount of cooling wind flow in the cooling wind passage 12 side.

Here, the flow of the cooling wind in this embodiment will be described. The cooling wind is pushed out toward the rotational direction of the cooling fan 5. The cooling wind then collides with the bend 8 and thus is divided into flows toward the upper side wall 27 and the lower side wall 28 directions, like the cooling wind flows 29*a* and 29*b* shown in FIG. 3. The flows divided into the upper and lower directions are brought closer toward the connection 13 by the inclined flow passage walls 27 and 28. The flows may thus be straightened toward the connection 13, thereby making the flow velocity distribution uniform.

In addition, although in this embodiment in FIG. 3, the lower side wall 28 is parallel with the drive shaft 3 and the upper side wall 27 is inclined downward toward the downstream, the lower side wall 28 may be inclined upward toward the downstream and the upper side wall 27 may be in parallel with the drive shaft 3. In addition, the lower side wall 28 may be inclined upward toward the downstream and the upper side wall 27 may be inclined downward toward the downstream.

Thus, according to this embodiment, the dimension in the upper and lower directions upstream of the cooling wind passage 12 is larger than the dimension in the upper and lower directions on the downward side. This may reduce the flow passage loss upstream of the cooling wind passage 12, thereby improving the cooling efficiency of the compressor body 1.

Although Embodiments 1 and 2 have been described with respect to a scroll air compressor as a scroll fluid machine, the present invention is not limited to a scroll fluid machine. The present invention is also applicable to any fluid machine (fluid compressor) that is driven by a motor and needs to improve the cooling efficiency, such as a reciprocating compressor or a screw compressor. Meanwhile, the present invention may be applied to a scroll fluid machine in which it is important to balance the cooling of the fixed scroll and the orbiting scroll, thereby improving the cooling efficiency even more.

The embodiments described so far only show examples of the implementation to practice the present invention, and they do not construe the scope of the invention in a limited manner. In other words, the present invention may be implemented in various forms without departing from the technical idea and the main features thereof.

The invention claimed is:

1. A scroll fluid machine comprising:

a compressor body having a fixed scroll and an orbiting scroll, opposed to the fixed scroll, to make orbiting motions;

a motor, accommodated by a motor casing, having a drive shaft extending along a drive shaft axis and connected on one side of the motor to the orbiting scroll;

a cooling fan provided on the drive shaft on another side of the motor opposite to the orbiting scroll, the cooling fan generating a cooling wind; and a cooling wind passage circumferentially surrounded by walls in all directions, the cooling wind passage sending the cooling wind of the cooling fan to the compressor body and being separated from the motor casing by the walls, wherein upstream portions of the cooling wind passage are smaller than downstream portions of the cooling wind passage in a first direction perpendicular to the drive shaft axis, and wherein, in the cooling wind passage, a radially inner side of a cooling passage outlet is closer to the drive shaft than a radially inner side of a cooling passage inlet.

2. The scroll fluid machine according to claim 1, further comprising a fan casing having the cooling fan disposed therein, wherein the fan casing and the cooling wind passage are connected by a bend.

3. The scroll fluid machine according to claim 1, wherein the cooling wind passage is connected to an introduction duct supplying the cooling wind to the compressor body.

4. The scroll fluid machine according to claim 3, wherein a radially outer side of the cooling wind passage is connected to an introduction wall of the introduction duct, and the introduction wall is inclined toward the drive shaft axis from upstream to downstream.

5. The scroll fluid machine according to claim 1, wherein one of the walls is a radially inner wall located nearer to the drive shaft axis than another of the walls, which is a radially outer wall.

6. A scroll fluid machine comprising:

a compressor body having a fixed scroll and an orbiting scroll, opposed to the fixed scroll, to make orbiting motions;

a motor, accommodated by a motor casing, having a drive shaft extending along a drive shaft axis and connected on one side of the motor to the orbiting scroll;

a cooling fan provided on the drive shaft on another side of the motor opposite to the orbiting scroll, the cooling fan generating a cooling wind; and a cooling wind passage circumferentially surrounded by walls, the cooling wind passage sending the cooling wind of the cooling fan to the compressor body and being separated from the motor casing by the walls, wherein upstream portions of the cooling wind passage are smaller than downstream portions of the cooling wind passage in a first direction perpendicular to the drive shaft axis, and wherein a dimension of the cooling wind passage in a second direction perpendicular to both the first direction and the drive shaft axis is larger at said upstream portions than at said downstream portions.

7. A scroll fluid machine comprising:

a compressor body compressing air;

a motor, accommodated by a motor casing, having a drive shaft extending along a drive shaft axis and driving the compressor body on one side of the motor;

a cooling fan provided on the drive shaft on a side of the motor opposite to the compressor body, the cooling fan generating a cooling wind; and a cooling wind passage sending the cooling wind of the cooling fan to the compressor body, the cooling wind passage defined by walls comprising an inside wall, separating the cooling wind passage from the motor casing, and an outside wall separated from the inside wall by a distance in a first direction perpendicular to the drive shaft axis, wherein the distance in the first direction between the inside wall and the outside wall on an upstream side of the cooling wind passage is smaller than the distance in the first direction between the inside wall and the outside wall on a downstream side of the cooling wind passage, and wherein the inside wall is inclined toward the drive shaft axis from upstream to downstream.

8. The scroll fluid machine according to claim 7, further comprising a fan casing having the cooling fan disposed therein, wherein the fan casing and the cooling wind passage are connected by a bend.

9. The scroll fluid machine according to claim 7, wherein the cooling wind flows in the cooling wind passage and is supplied to the compressor body via an introduction duct.

10. The scroll fluid machine according to claim 9, wherein the outside wall is connected to an introduction wall of the introduction duct, and the introduction wall is inclined toward the drive shaft axis from upstream to downstream.

11. The scroll fluid machine according to claim 7, wherein the inside wall is located nearer to the drive shaft axis than the outside wall.

12. A scroll fluid machine comprising:

a compressor body compressing air;

a motor accommodated by a motor casing and having a drive shaft driving the compressor body on one side of the motor;

a cooling fan provided on the drive shaft on a side of the motor opposite to the compressor body, the cooling fan generating a cooling wind; and a cooling wind passage sending the cooling wind of the cooling fan to the compressor body, the cooling wind passage defined by an inside wall, separating the cooling wind passage from the motor casing, and an outside wall separated from the inside wall by a distance in a first direction perpendicular to the drive shaft axis, wherein the distance in the first direction between the inside wall and the outside wall on an upstream side of the cooling wind passage is smaller than the distance in the first direction between the inside wall and the outside wall on a downstream side of the cooling wind passage, and wherein the cooling wind passage is further defined by an upper side wall and a lower side wall separated by a distance in a second direction perpendicular to both the first direction and the drive shaft axis, and the distance in the second direction between the upper side wall and the lower side wall on the upstream side is larger than the distance in the second direction between the upper side wall and the lower side wall on the downstream side.

* * * * *